US009055378B2

(12) United States Patent
Kindred

(10) Patent No.: US 9,055,378 B2
(45) Date of Patent: Jun. 9, 2015

(54) MICROMACHINED ULTRASONIC TRANSDUCER SWITCH FOR HEARING ASSISTANCE DEVICES

(71) Applicant: Starkey Laboratories, Inc., Eden Prairie, MN (US)

(72) Inventor: Jon S. Kindred, Minneapolis, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 13/715,248

(22) Filed: Dec. 14, 2012

(65) Prior Publication Data

US 2014/0169598 A1 Jun. 19, 2014

(51) Int. Cl.
*H04R 25/00* (2006.01)

(52) U.S. Cl.
CPC ..... *H04R 25/55* (2013.01); *H04R 25/00* (2013.01)

(58) Field of Classification Search
CPC ..... H04R 25/00; H04R 25/02; H04R 25/55; H04R 25/552; H04R 25/554; H04R 25/558
USPC ..... 381/60, 67, 312, 315, 328, 330, 331
See application file for complete search history.

(56) References Cited

U.S. PATENT DOCUMENTS

| | | | | |
|---|---|---|---|---|
| 2005/0238190 | A1 | 10/2005 | Rohrlein | |
| 2006/0210090 | A1 * | 9/2006 | Shennib | 381/67 |
| 2008/0123882 | A1 | 5/2008 | Bauml et al. | |
| 2009/0123013 | A1 | 5/2009 | Leong | |
| 2009/0189488 | A1 * | 7/2009 | Ray et al. | 310/334 |
| 2012/0180788 | A1 * | 7/2012 | Imran | 128/201.19 |

OTHER PUBLICATIONS

"European Application Serial No. 13196769.7, Extended European Search Report mailed Feb. 17, 2014", 6 pgs.

* cited by examiner

*Primary Examiner* — Tuan D Nguyen
(74) *Attorney, Agent, or Firm* — Schwegman Lundberg & Woessner, P.A.

(57) ABSTRACT

Disclosed herein, among other things, are apparatus and methods for micromachined ultrasonic transducer switches for hearing assistance devices. In various embodiments, a hearing assistance device includes a housing, hearing assistance electronics within the housing, and a micromachined ultrasonic transducer connected to the hearing assistance electronics. The micromachined ultrasonic transducer is configured to switch upon detection of proximity or touch by the wearer. In various embodiments, the micromachined ultrasonic transducer includes one ultrasonic transmitter and one ultrasonic receiver. The micromachined ultrasonic transducer is adapted to control one or more functions of the hearing assistance electronics, in various embodiments.

20 Claims, 2 Drawing Sheets

MICROMACHINED ULTRASONIC TRANSDUCER SWITCH FOR HEARING ASSISTANCE DEVICES

TECHNICAL FIELD

This document relates generally to hearing assistance systems and more particularly to a hearing assistance device with a micromachined ultrasonic transducer as a switch.

BACKGROUND

Hearing assistance devices are used to assist patient's suffering hearing loss by transmitting amplified sounds to ear canals. In one example, a hearing aid is worn in and/or around a patient's ear. Patients prefer that their hearing aids are minimally visible or invisible, do not interfere with their daily activities, and are easy for them to control during use, such as pairing the device with an external programmer, turning the device on/off and adjusting sound volume. One area of particular concern is how to operate hearing aid devices in view of shrinking package sizes, limited power, and an increasingly more adult population with limited or diminishing manual dexterity.

Accordingly, there is a need in the art for improved switching and sensing for hearing assistance devices.

SUMMARY

Disclosed herein, among other things, are apparatus and methods for micromachined ultrasonic transducer switches for hearing assistance devices. In various embodiments, a hearing assistance device includes a housing, hearing assistance electronics within the housing, and a micromachined ultrasonic transducer connected to the hearing assistance electronics. The micromachined ultrasonic transducer is configured to switch upon detection of proximity or touch by the wearer. In various embodiments, the micromachined ultrasonic transducer includes one ultrasonic transmitter and one ultrasonic receiver. The micromachined ultrasonic transducer is adapted to control one or more functions of the hearing assistance electronics, in various embodiments.

One aspect of the present subject matter includes a method of using a hearing assistance device for a wearer. The method includes detecting proximity or touch by the wearer using a micromachined ultrasonic transducer connected to hearing assistance electronics, and switching state of the micromachined ultrasonic transducer upon detection of proximity or touch by the wearer, according to various embodiments.

This Summary is an overview of some of the teachings of the present application and not intended to be an exclusive or exhaustive treatment of the present subject matter. Further details about the present subject matter are found in the detailed description and appended claims. The scope of the present invention is defined by the appended claims and their legal equivalents.

DETAILED DESCRIPTION

Figure 1A:
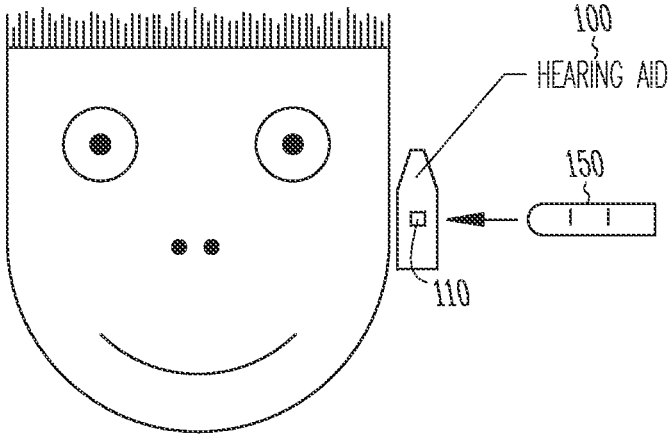
FIGS. 1A-1B illustrate a behind-the-ear hearing assistance device with a micromachined ultrasonic transducer, according to various embodiments of the present subject matter.

The following detailed description of the present subject matter refers to subject matter in the accompanying drawings which show, by way of illustration, specific aspects and embodiments in which the present subject matter may be practiced. These embodiments are described in sufficient detail to enable those skilled in the art to practice the present subject matter. References to "an", "one", or "various" embodiments in this disclosure are not necessarily to the same embodiment, and such references contemplate more than one embodiment. The following detailed description is demonstrative and not to be taken in a limiting sense. The scope of the present subject matter is defined by the appended claims, along with the full scope of legal equivalents to which such claims are entitled.

The present detailed description will discuss hearing assistance devices using the example of hearing aids. Hearing aids are only one type of hearing assistance device. Other hearing assistance devices include, but are not limited to, those in this document. It is understood that their use in the description is intended to demonstrate the present subject matter, but not in a limited or exclusive or exhaustive sense.

Hearing aids typically include a housing or shell with internal components such as a microphone, electronics and a speaker. Patients prefer that their hearing aids are minimally visible or invisible, do not interfere with their daily activities, and are easy for them to control during use. It is common for an elderly user of a hearing assistive device to have poor manual dexterity. There is a desire, therefore, to have smart functionality in the form of momentary switching, on/off detection, and volume control, thereby requiring less effort by the user. It would be advantageous to perform this smart functionality with a small form factor, with low electrical power consumption, without the need to touch a specific location on the hearing device, and from within the hearing device without any physical penetrations through the exterior plastic housing. Physical penetrations of the housing provide potential paths for moisture and debris ingress, which can affect device performance and longevity.

Disclosed herein, among other things, are apparatus and methods for micromachined ultrasonic transducer switches for hearing assistance devices. In various embodiments, a hearing assistance device includes a housing, hearing assistance electronics within the housing, and a micromachined ultrasonic transducer connected to the hearing assistance electronics. The micromachined ultrasonic transducer is configured to switch upon detection of proximity or touch by the wearer. In various embodiments, the micromachined ultrasonic transducer includes one ultrasonic transmitter and one ultrasonic receiver. The micromachined ultrasonic transducer is adapted to control one or more functions of the hearing assistance electronics, in various embodiments.

In various embodiments, the micromachined ultrasonic transducer is adapted to turn the device on and off. The housing is adapted to mount in or about an ear of a person, in various embodiments. The hearing assistance electronics include a wireless communication unit, in an embodiment. In various embodiments, the micromachined ultrasonic transducer is approximately 1 mm square. The micromachined ultrasonic transducer is configured to operate using less than approximately 10 μW power, in various embodiments. In one embodiment, the device includes an array of micromachined ultrasonic transducers. The micromachined ultrasonic transducer array is adapted to determine a direction of a swipe by the wearer's finger, in an embodiment.

An ultrasonic transducer is comprised of an ultrasonic transmitter (or ultrasonic wave source) and an ultrasonic receiver (or ultrasonic sensor). In various embodiments, the ultrasonic transducer can be fabricated from aluminum nitride (AlN) or lead zirconate titanate (PZT) or other piezoelectric ceramic materials. Other types of materials can be used to fabricate the transducer without departing from the scope of the present subject matter. In various embodiments, ultrasonic transducers operate from a low end of approximately 20 kHz up to higher frequencies of approximately 40 MHz for high frequency piezoelectric micromachined ultrasonic transducers (PMUT). In various embodiments, a small transducer array is used to keep current consumption low. The micromachined ultrasonic transducer is within the housing in various embodiments, with mesh or holes in the housing to allow sound to pass back and forth through the housing.

One aspect of the present subject matter includes a method of using a hearing assistance device for a wearer. The method includes detecting proximity or touch by the wearer using a micromachined ultrasonic transducer connected to hearing assistance electronics, and switching state of the micromachined ultrasonic transducer upon detection of proximity or touch by the wearer, according to various embodiments. In various embodiments, using the micromachined ultrasonic transducer includes using a micromachined ultrasonic transducer having one ultrasonic transmitter and one ultrasonic receiver. Switching state of the micromachined ultrasonic transducer includes controlling one or more functions of the hearing assistance electronics, in various embodiments. In one embodiment, switching state of the micromachined ultrasonic transducer includes turning the device on or off.

The present subject matter provides a micromachined ultrasonic transducer or an array of micromachined ultrasonic transducers as a momentary switch, a volume control, or a power on/off switch in a hearing assistive device. The micromachined ultrasonic transducer sensor/switch does not require physical contact with the user in order to be triggered. The present subject matter is used to sense the presence of an object extremely close to the sensor, in an embodiment. The micromachined ultrasonic transducer can be quite small, on the order of 1 mm square, and very low power, on the order of a single digit microwatt (less than 10 μW), in an embodiment. It can be integrated into the device without any seams, cracks, or penetrations, and still maintain a relatively high range of detection.

Benefits of the present subject matter include, but are not limited to: 1) the chip scale electronics for the micromachined ultrasonic transducer are smaller than today's capacitive switch electronics; 2) the sensor can be integrated inside the device and sense objects moving directly outside the housing; objects moving outside the device, i.e., a finger for example, does not need to contact the sensor directly; 3) the micromachined ultrasonic transducer switch has no moving parts; 4) the micromachined ultrasonic transducer switch is not prone to false triggers unlike a capacitive switch; 5) the micromachined ultrasonic transducer switch consumes far less power than a capacitive switch; and 6) the micromachined ultrasonic transducer switch is easier to manufacture than other switches.

Figure 1B:
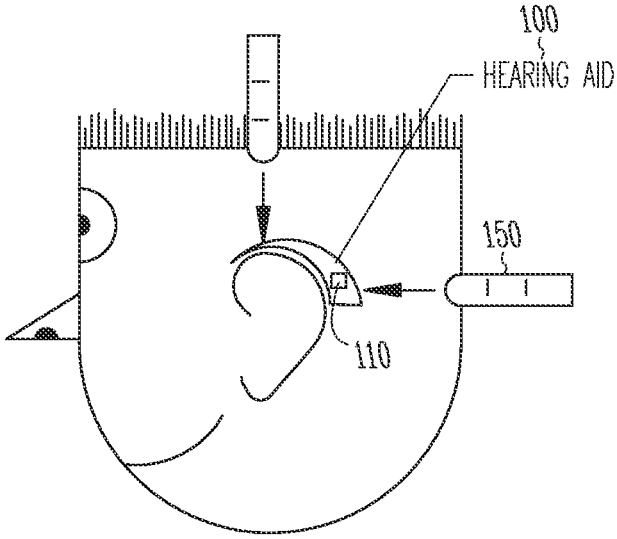

FIGS. 1A-1B illustrate a behind-the-ear hearing assistance device 100 with a micromachined ultrasonic transducer 110, according to various embodiments of the present subject matter. By "tapping" or "swiping" at appropriate locations on or near the device using a wearer's finger 150, volume changes and memory changes can be performed, for example. Other functions and parameter changes can be performed without departing from the scope of this disclosure. For example, the micromachined ultrasonic transducer can be used to control ON/OFF functionality for the instrument in various embodiments.

Figure 2:
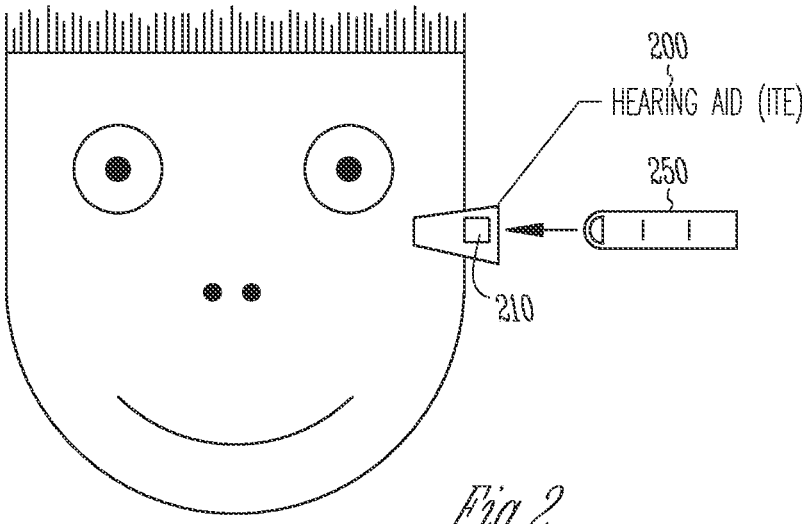
FIG. 2 illustrates an in-the-ear hearing assistance device with a micromachined ultrasonic transducer, according to various embodiments of the present subject matter.

The micromachined ultrasonic transducer can also be used with in-the-ear (ITE) devices. As shown in FIG. 2, a tapping or swiping action with a finger 250 on or near the surface of the ITE hearing device 200 can be detected by a micromachined ultrasonic transducer 210 and processed. For ITE devices, especially completely-in-canal (CIC) formats, it is difficult to incorporate traditional electromechanical sensor components because of surface area and volume constraints. As a result, the user ends up with limited control over their hearing device They are forced into using only one memory program, with no ability to alter loudness, and no way to place the device into telecoil mode for improved telephone performance. Benefits of the micromachined ultrasonic transducer include freedom of placement within the hearing device and resistance to water and moisture.

Figure 3:
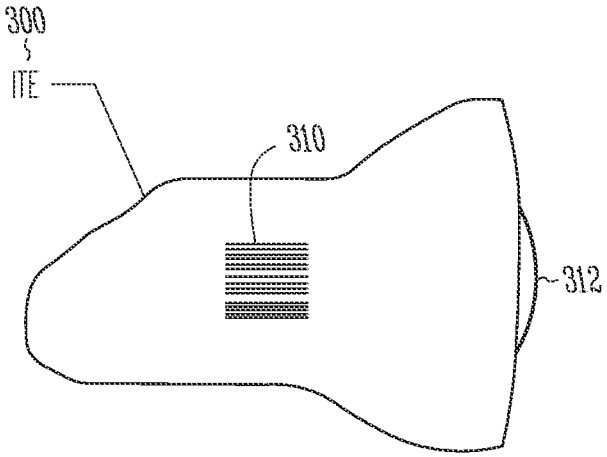
FIG. 3 illustrates an in-the-ear hearing assistance device with a micromachined ultrasonic transducer for an automatic on-off feature, according to various embodiments of the present subject matter.

FIG. 3 illustrates an in-the-ear hearing assistance device 300 with a micromachined ultrasonic transducer 310 for an automatic on-off feature, according to various embodiments of the present subject matter. In various embodiments, a second infrared sensor 312 is also used to sense proximity or touch by the wearer. In various embodiments, the automatic on-off feature involves sensing whether the device 300 is in an ear canal. For example, if the device 300 is sensed to be in the canal then it is turned on. When the ITE device 300 (or ear piece of a BTE, in an embodiment) is placed in the ear canal, the micromachined ultrasonic transducer switch 310 is activated to turn on the device.

It is further understood that any hearing assistance device may be used without departing from the scope and the devices depicted in the figures are intended to demonstrate the subject matter, but not in a limited, exhaustive, or exclusive sense. It is also understood that the present subject matter can be used with a device designed for use in the right ear or the left ear or both ears of the wearer.

It is understood that the hearing aids referenced in this patent application include a processor. The processor may be a digital signal processor (DSP), microprocessor, microcontroller, other digital logic, or combinations thereof. The processing of signals referenced in this application can be performed using the processor. Processing may be done in the digital domain, the analog domain, or combinations thereof. Processing may be done using subband processing techniques. Processing may be done with frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, and certain types of filtering and processing. In various embodiments the processor is adapted to perform instructions stored in memory which may or may not be explicitly shown. Various types of memory may be used, including volatile and nonvolatile forms of memory. In various embodiments, instructions are performed by the processor to perform a number of signal processing tasks. In such embodiments, analog components are in communication with the processor to perform signal tasks, such as microphone reception, or receiver sound embodiments (i.e., in applications where such transducers are used). In various embodiments, different realizations of the block diagrams, circuits, and processes set forth herein may occur without departing from the scope of the present subject matter.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard, open fitted or occlusive fitted. It is understood that other hearing assistance devices not expressly stated herein may be used in conjunction with the present subject matter.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device for a wearer, comprising:

a housing configured to be worn in or about an ear of the wearer;

hearing assistance electronics within the housing;

a micromachined ultrasonic transducer array on or in the housing connected to the hearing assistance electronics, wherein the micromachined ultrasonic transducer array includes more than two ultrasonic transducers, and wherein at least one of the ultrasonic transducers is configured to turn the device on in response to placement of the device on or in the ear of the wearer; and a second sensor in the housing and configured to sense proximity or touch by the wearer.

2. The device of claim 1, wherein the micromachined ultrasonic transducer includes one ultrasonic transmitter and one ultrasonic receiver.

3. The device of claim 1, wherein the micromachined ultrasonic transducer is adapted to control one or more functions of the hearing assistance electronics.

4. The device of claim 1, wherein the micromachined ultrasonic transducer is adapted to turn the device on and off.

5. The device of claim 1, wherein the ultrasonic transducer includes a piezoelectric ceramic material.

6. The device of claim 1, wherein the hearing assistance electronics include a wireless communication unit.

7. The device of claim 1, wherein the micromachined ultrasonic transducer is approximately 1 mm square.

8. The device of claim 1, wherein the micromachined ultrasonic transducer is configured to operate using less than approximately 10 μW power.

9. The device of claim 1, wherein further comprising an array of micromachined ultrasonic transducers.

10. The device of claim 9, wherein the micromachined ultrasonic transducer array is adapted to determine a direction of a swipe by the wearer's finger.

11. The device of claim 1, wherein the housing includes an in-the-ear (ITE) hearing aid housing.

12. The device of claim 1, wherein the housing includes a behind-the-ear (BTE) housing.

13. The device of claim 1, wherein the housing includes an in-the-canal (ITC) housing.

14. The device of claim 1, wherein the housing includes a receiver-in-canal (RIC) housing.

15. The device of claim 1, wherein the housing includes a completely-in-the-canal (CIC) housing.

16. The device of claim 1, wherein the housing includes a receiver-in-the-ear (RITE) housing.

17. A method of using a hearing assistance device for a wearer, the hearing assistance device including a housing configured to be worn in or about an ear of the wearer, the method comprising:

detecting the wearer using a micromachined ultrasonic transducer array on or in the housing connected to hearing assistance electronics within the housing, wherein the array includes more than two ultrasonic transducers;

detecting proximity or touch by the wearer using a second sensor in the housing; and controlling one or more functions of the hearing assistance device upon detection of proximity or touch by the wearer.

18. The method of claim 17, wherein using the micromachined ultrasonic transducer includes using a micromachined ultrasonic transducer having one ultrasonic transmitter and one ultrasonic receiver.

19. The method of claim 17, wherein switching state of the micromachined ultrasonic transducer includes controlling one or more functions of the hearing assistance electronics.

20. The method of claim 17, wherein switching state of the micromachined ultrasonic transducer includes turning the device on or off.

* * * * *